US011712145B2

(12) United States Patent
Li et al.

(10) Patent No.: US 11,712,145 B2
(45) Date of Patent: Aug. 1, 2023

(54) RESERVOIR DEVICE AND CLEANING APPARATUS

(71) Applicant: SHENZHEN FLY RODENT DYNAMICS INTELLIGENT TECHNOLOGY CO., LTD., Guangdong (CN)

(72) Inventors: Jun Li, Guangdong (CN); Linlin Zhou, Guangdong (CN)

(73) Assignee: SHENZHEN FLY RODENT DYNAMICS INTELLIGENT TECHNOLOGY CO., LTD., Shenzhen (CN)

( * ) Notice: Subject to any disclaimer, the term of this patent is extended or adjusted under 35 U.S.C. 154(b) by 0 days.

(21) Appl. No.: 17/555,842

(22) Filed: Dec. 20, 2021

(65) Prior Publication Data

US 2022/0313048 A1 Oct. 6, 2022

(30) Foreign Application Priority Data

Mar. 30, 2021 (CN) ..... 202110343275.5

(51) Int. Cl.
*A47L 11/40* (2006.01)

(52) U.S. Cl.
CPC ..... *A47L 11/4019* (2013.01); *A47L 11/4083* (2013.01); *A47L 11/4088* (2013.01)

(58) Field of Classification Search
CPC ..... A47L 11/4019; A47L 11/4083; A47L 11/4088; A47L 11/408; A47L 11/4011; A47L 2201/00; A47L 2201/028; A47L 2201/06; A47L 11/145; A47L 11/185; A47L 7/0028; A47L 7/0057; A61M 1/60; A47J 31/00; G01F 23/58; G01F 23/62; G01F 23/74; G01F 23/56; G01F 1/56; G01F 23/26
USPC ..... 15/3
See application file for complete search history.

(56) References Cited

FOREIGN PATENT DOCUMENTS

CN 205993101 U * 3/2017

OTHER PUBLICATIONS

CN-205993101-U translation (Year: 2017).*

* cited by examiner

*Primary Examiner* — Monica S Carter
*Assistant Examiner* — Abbie E Quann
(74) *Attorney, Agent, or Firm* — Gang Yu

(57) ABSTRACT

A reservoir device includes: a liquid storage structure, configured to store liquid; a liquid feeding assembly, configured to feed the liquid into the liquid storage structure; a barrier assembly; a sensing field generator, configured to generate a sensing field; a sensor; and an electrical control assembly. The barrier assembly is arranged inside the liquid storage structure. The sensor is configured to sense the sensing field. The barrier assembly is configured to float under a buoyance action of the liquid, and to block the sensor from sensing the sensing field when the barrier assembly floats in a first liquid level position. The electrical control assembly is configured to control the liquid feeding assembly to stop feeding the liquid into the liquid storage structure when the barrier assembly blocks the sensor from sensing the sensing field.

20 Claims, 6 Drawing Sheets

RESERVOIR DEVICE AND CLEANING APPARATUS

CROSS-REFERENCE TO RELATED APPLICATIONS

Pursuant to 35 U.S.C. § 119 and the Paris Convention, this application claims the benefit of Chinese Patent Application No. 202110343275.5 filed Mar. 30, 2021, the contents of which are incorporated herein by reference.

TECHNICAL FIELD

The present application relates to the field of cleaning technology, and more particularly to a reservoir device and a cleaning apparatus.

BACKGROUND

A reservoir device is a device for collecting liquid. However, overflowing of the liquid may easily occur during the liquid entering the reservoir device, and when the liquid collected in the reservoir device reaches a preset liquid lever, accident may easily occur if the liquid may not be stopped from entering the reservoir device in time.

SUMMARY

In view of the above technical problems, it is an object of the present application to provide reservoir device and a cleaning apparatus, which aims at solving the technical problems in the existing reservoir device that the liquid may not timely be stopped from entering the reservoir device when the collected liquid reaches a preset liquid level, which may easily cause accidents.

To achieve the above object, the following technical solutions of the present applications are adopted A first aspect of the present application provides a reservoir device. The reservoir device comprises:

a liquid storage structure, configured to store liquid;

a liquid feeder, configured to feed the liquid into the liquid storage structure;

a barrier assembly;

a sensing field generator, configured to generate a sensing field;

a sensor; and an electrical controller.

The barrier assembly is arranged inside the liquid storage structure. The sensor is configured to sense the sensing field. The barrier assembly is configured to float under a buoyance action of the liquid, and to block the sensor from sensing the sensing field when the barrier assembly floats in a first liquid level position. The electrical controller is configured to control the liquid feeder to stop feeding the liquid into the liquid storage structure when the barrier assembly blocks the sensor from sensing the sensing field.

In an embodiment, the barrier assembly is further configured to stop the liquid feeder from feeding the liquid into the liquid storage structure when the barrier assembly floats in a second liquid level position.

In an embodiment, the liquid feeder comprises a liquid inlet and an air outlet, and both the liquid inlet and the air outlet are defined at the liquid storage structure. The air outlet is configured to connect with an air suction mechanism outside. The air suction mechanism is configured to draw air out of the liquid storage structure via the air outlet, so that a negative pressure is generated in the liquid storage structure, and the liquid enters the liquid storage structure through the liquid inlet. The air suction mechanism is configured to be in electrical connection with the electrical controller. The electrical controller is configured to control the air suction mechanism to stop drawing the air out of the liquid storage structure when the barrier assembly blocks the sensor from sensing the sensing field.

In an embodiment, the barrier assembly and the air outlet are configured to achieve a float connection between the barrier assembly and the air outlet.

In an embodiment, the electrical controller comprises an alarm. The alarm is configured to output a signal indicating that a liquid level of the liquid has reached or exceeded the first liquid level position, when the barrier assembly blocks the sensor from sensing the sensing field.

In an embodiment, the sensor is arranged outside the liquid storage structure.

In an embodiment, the sensing field generator is arranged inside the liquid storage structure.

In an embodiment, the sensing field generator is a magnet. The sensor is a Hall sensor. The Hall sensor is in electrical connection with the electrical controller.

In an embodiment, the barrier assembly comprises a floating part and a barrier part. The liquid storage structure is provided with a rod inside. The floating part is connected with the rod in a sliding manner. The barrier part is arranged at the floating part.

A second aspect of the present application provides a cleaning apparatus. The cleaning apparatus comprise a reservoir device. The reservoir device is the reservoir device as described in the above.

Advantages of the reservoir device and the cleaning apparatus according to embodiments of the present application are summarized as follows:

The liquid storage structure of the reservoir device provided by embodiments of the present application is configured to store the liquid. The liquid may flow into the liquid storage structure via the liquid feeder. The barrier assembly is arranged in the liquid storage structure. The sensor may sense the sensing field. The barrier assembly may float under the buoyancy action of the liquid, and may block the sensor from sensing the sensing field when reaching the first liquid level position. The electrical controller is configured to control the liquid feeder to stop feeding the liquid into the liquid storage structure when the barrier assembly blocks the sensor from sensing the sensing field. When the liquid collected in the liquid storage structure of the reservoir device reaches the first liquid level position, the electrical controller controls the liquid feeder to stop feeding the liquid into the liquid storage structure, such that the liquid is stopped from entering the reservoir device when the liquid gathered in the reservoir device has reached a preset liquid level, which avoids the accidents caused by overflow of the reservoir device.

The cleaning apparatus provided by embodiments of the present application includes the reservoir device as described in the above. When the liquid collected in the liquid storage structure of the reservoir device reaches the first liquid level position, the electrical controller controls the liquid feeder to stop feeding the liquid into the liquid storage structure, such that the liquid is stopped from entering the reservoir device when the liquid gathered in the reservoir device has reached a preset liquid level, which avoids the accidents caused by overflow of the reservoir device. In this way, the user experience is improved.

BRIEF DESCRIPTION OF THE DRAWINGS

In order to illustrate the technical solutions more clearly in the embodiments of the present application, the drawings that need to be used in the description of the embodiments or the prior art will be briefly described hereinbelow. Obviously, the accompanying drawings in the following description are only some embodiments of the present application. For those skilled in the art, other drawings may be obtained based on these drawings without creative work.

Figure 1:
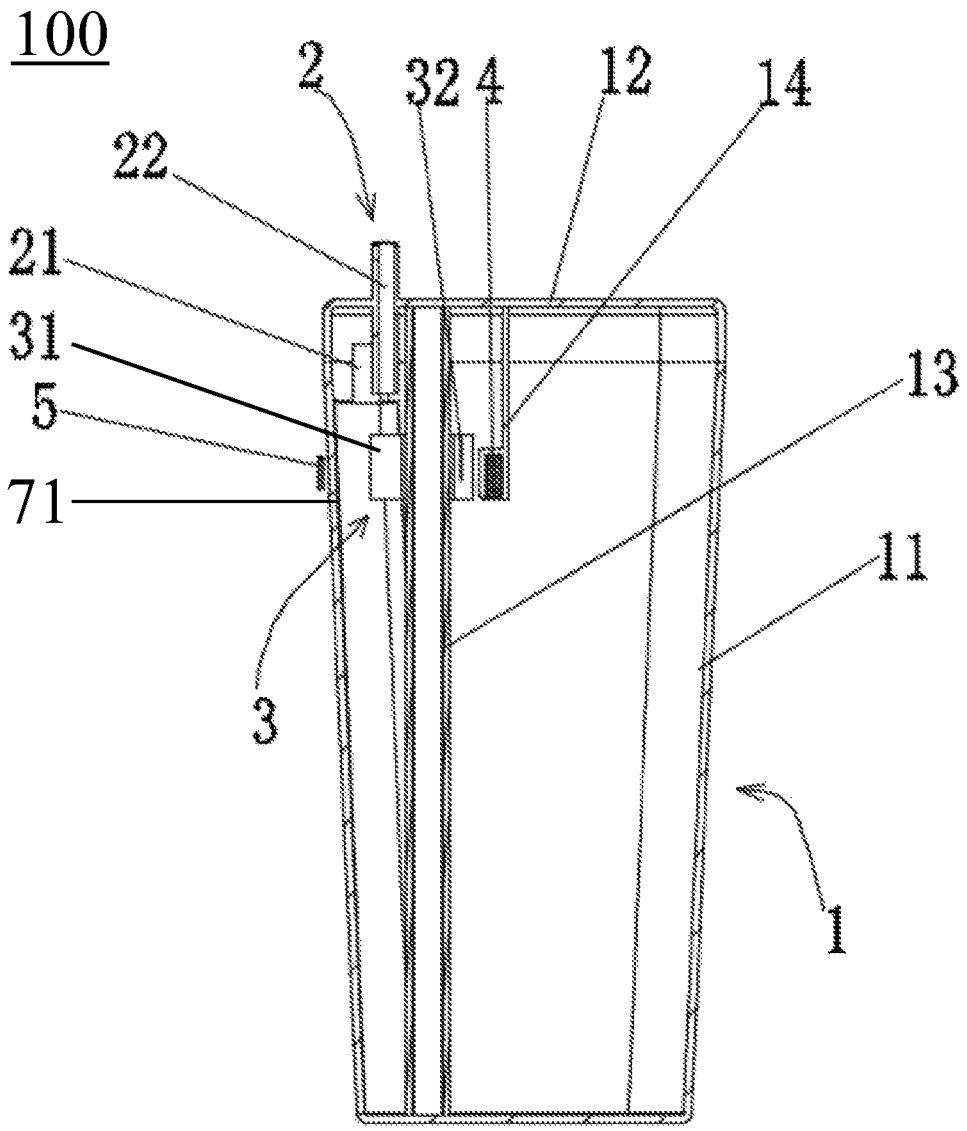
FIG. 1 is a structural schematic view of a reservoir device provided by an embodiment of the present application when a barrier assembly is positioned at a first liquid level position.

In the drawings, the following reference numerals are adopted: 1: Liquid storage structure; 2: Liquid feeder; 3: Barrier assembly; 4: Sensing field generator; 5: Sensor; 6: Electrical controller; 8: Air suction mechanism; 11: Tank; 12: Cover; 13: Rod; 14: Installation bracket; 21: Liquid inlet; 22: Air outlet; 31: Float; 32: Barrier; 61: Alarm; 71: First liquid level position; 72: Second liquid level position; 100: Reservoir device; and 200: Cleaning apparatus.

DETAILED DESCRIPTION OF THE EMBODIMENTS

In order to make the purposes, technical solutions, and advantages of the present application clearer and more understandable, the present application will be further described in detail hereinafter with reference to the accompanying drawings and embodiments. Obviously, the described embodiments are only a part of, rather than all the embodiments of the present application. Based on the embodiments of the present invention, all other embodiments obtained by those skilled in the art without creative work shall fall within the protection scope of the present application.

In the description of the present application, it should be understood that the terms "including" and "having" and any variations thereof used herein are intended to cover non-exclusive inclusions, for example, a process, method, system, product, or device that includes a series of steps or units may not be necessarily limited to those clearly listed steps or units, but may include other steps or units that are not clearly listed or are inherent to the process, method, system, product, or device.

It should be noted that when an element is described as "fixed" or "arranged" on/at another element, it means that the element may be directly or indirectly fixed or arranged on/at another element. When an element is described as "connected" to/with another element, it means that the element may be directly or indirectly connected to/with another element.

It should be understood that terms "length", "width", "upper", "lower", "front", "rear", "left", "right", "vertical", "horizontal", "top", "bottom", "inside", "outside" and the like indicating orientation or positional relationship are based on the orientation or the positional relationship shown in the drawings, and are merely for facilitating and simplifying the description of the present application, rather than indicating or implying that an apparatus or component must have a particular orientation, or be configured or operated in a particular orientation, and thus should not be construed as limiting the application.

In addition, terms like "first" and "second" are only used for the purpose of description, and will in no way be interpreted as indication or hint of relative importance or implicitly indicate the number of the referred technical features.

A reservoir device and a cleaning apparatus provided by the present application are described in details with reference to specific embodiments.

FIG. 1 is a structural schematic view of a reservoir device provided by an embodiment of the present application when a barrier assembly is positioned at a first liquid level position. As shown in FIG. 1, a reservoir device is provided by a first aspect of embodiments of the present application. The reservoir device comprises: a liquid storage structure 1, a liquid feeder 2, a barrier assembly 3, a sensing field generator 4, a sensor 5, and an electrical controller. The liquid storage structure 1 is configured to store liquid. The liquid feeder 2 is configured to feed the liquid into the liquid storage structure 1. The sensing field generator 4 is configured to generate a sensing field. The barrier assembly 3 is arranged inside the liquid storage structure 1. The sensor 5 is configured to sense the sensing field. The barrier assembly 3 is configured to float under a buoyance action of the liquid, and to block the sensor 5 from sensing the sensing field when the barrier assembly floats in a first liquid level position. The electrical controller is configured to control the liquid feeder 2 to stop feeding the liquid into the liquid storage structure 1 when the barrier assembly 3 blocks the sensor 5 from sensing the sensing field.

The liquid storage structure 1 provided by this embodiment is used to store the liquid. Specific material and dimension of the liquid storage structure 1 are not particularly restricted herein. The liquid flows into the liquid storage structure 1 through the liquid feeder 2.

As an example, rather than limitation, the liquid may be any of the following: dirty water, clear water, and disinfectant. The liquid storage structure 1 may include a tank 11 and a cover 12. The tank 11 and the cover 12 are in hermetical connection. Besides, the tank 11 and the cover 12 are in detachable connection, which is convenient for the user to clean the liquid storage structure 1.

The liquid feeder 2 provided by this embodiment is a structure configured for feeding the liquid into the liquid storage structure 1. As an example, rather than limitation, the liquid feeder 2 may include at least one of the following: a liquid inlet pipe, a liquid inlet, and a water pump.

The sensing field generator 4 provided by this embodiment is configured to generate a sensing field. The sensor 5 is configured to sense the sensing field. The sensing field generator 4 and the sensor 5 are both positioned above a bottom surface of the liquid storage structure 1. As an example, rather than limitation, the sensing field generator 4 provided by this embodiment may be an infrared generator, and the corresponding sensor 5 may be an infrared receiver; or alternatively, the sensing field generator 4 provided by this embodiment may be a magnet, and the corresponding sensor 5 may be a Hall sensor.

In this embodiment, since the density of the barrier assembly 3 is smaller than that of the liquid, the barrier assembly 3 may float under the buoyancy action of the liquid. A floating space for the barrier assembly 3 is provided between the sensing field generator 4 and the sensor 5. When floating in the first liquid level position, the barrier assembly 3 blocks the sensor 5 from sensing the sensing field generated by the sensing field generator 4. The electrical controller controls the liquid feeder 2 to stop feeding the liquid into the liquid storage structure 1 when the barrier assembly 3 blocks the sensor 5 from sensing the sensing field. In this embodiment, the electrical controller provides the electrical control protection for the liquid storage structure 1, so as to prevent the liquid from overflowing out of the liquid storage structure 1.

The liquid storage structure of the reservoir device provided by this embodiment is configured to store the liquid. The liquid may flow into the liquid storage structure via the liquid feeder. The barrier assembly is arranged in the liquid storage structure. The sensor is configured to sense the sensing field. The barrier assembly may float under the buoyancy action of the liquid, and may block the sensor from sensing the sensing field when reaching the first liquid level position. The electrical controller is configured to control the liquid feeder to stop feeding the liquid into the liquid storage structure when the barrier assembly blocks the sensor from sensing the sensing field. When the liquid stored in the liquid storage structure of the reservoir device reaches the first liquid level position, the electrical controller controls the liquid feeder to stop feeding the liquid into the liquid storage structure, such that the liquid is stopped from entering the reservoir device when the liquid stored in the reservoir device has reached a preset liquid level, which avoids the accidents caused by overflow of the reservoir device.

Figure 2:
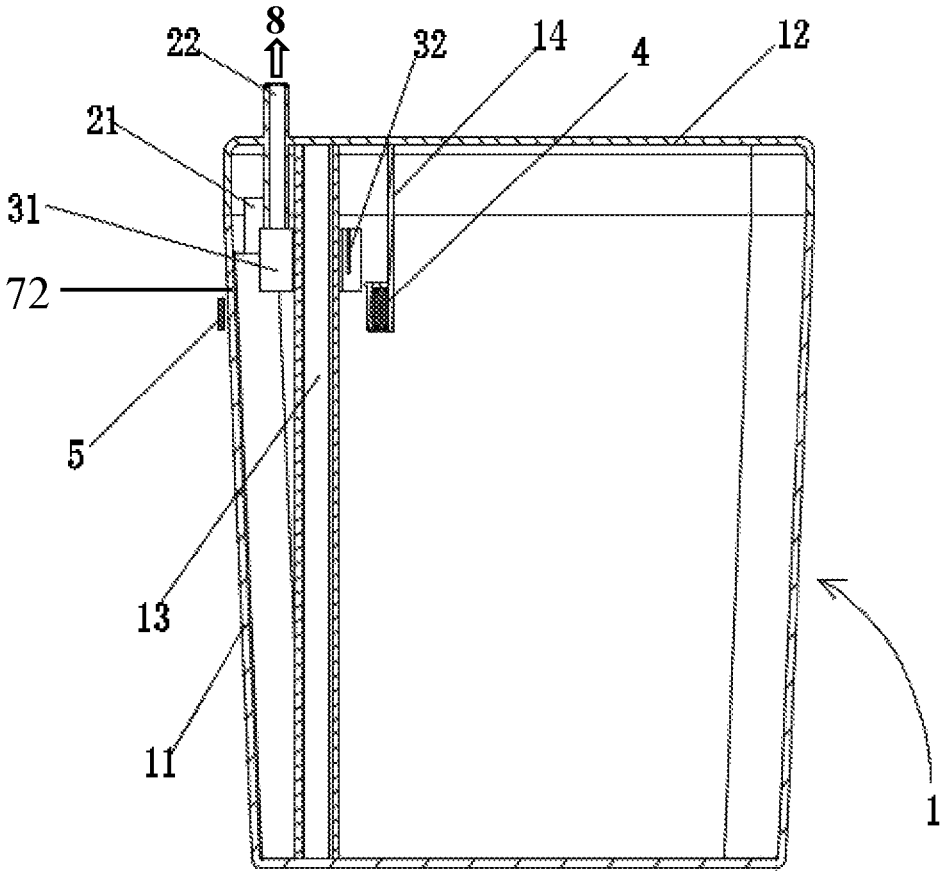
FIG. 2 is a structural schematic view of a reservoir device provided by an embodiment of the present application when the barrier assembly is positioned at a second liquid level position.

Furthermore, FIG. 2 is a structural schematic view of a reservoir device provided by an embodiment of the present application when the barrier assembly is positioned at a second liquid level position. As shown in FIG. 2, in an embodiment, the barrier assembly 3 is further configured to enable the liquid feeder 2 to stop feeding the liquid into the liquid storage structure 1 when the barrier assembly 3 floats in a second liquid level position.

As an example, rather than limitation, scenario of failure in electrical control protection may be at least one of the following: disconnection of the electrical controller circuit, short-circuit of electrical controller circuit, and disfunction of the barrier assembly 3. In case of failure in electrical control protection, when the barrier assembly 3 reaches the first liquid level position, the electrical controller may not control the liquid feeder 2 to stop feeding the liquid into the liquid storage structure 1, the liquid level in the liquid storage structure 1 continues to rise, the barrier assembly 3 continues to float upwards under the buoyancy action of the liquid. When the barrier assembly 3 floats in the second liquid level position, the barrier assembly 3 may stop the liquid feeder 2 from feeding the liquid into the liquid storage structure 1, thus realizing the physical protection of the reservoir device, and avoiding the liquid from overflowing out of the reservoir device.

In an embodiment, the liquid feeder 2 comprises a liquid inlet 21 and an air outlet 22, both the liquid inlet 21 and the air outlet 22 are defined at the liquid storage structure 1. The air outlet 22 is configured to connect with an external air suction mechanism. The air suction mechanism is configured to draw air out of the liquid storage structure 1 via the air outlet 22, so that a negative pressure is generated in the liquid storage structure 1, and the liquid enters the liquid storage structure 1 through the liquid inlet 21. The air suction mechanism is configured to be in electrical connection with the electrical controller. The electrical controller is configured to control the air suction mechanism to stop drawing the air out of the liquid storage structure 1 when the barrier assembly 3 blocks the sensor 5 from sensing the sensing field. In this embodiment, the air suction mechanism may be selected as a vacuum pump. The specific form of the vacuum pump is not particularly limited in this embodiment. The vacuum pump is in connection with the air outlet 22 and is configured to draw the air out of the liquid storage structure 1.

In an embodiment, the barrier assembly 3 and the air outlet are configured to achieve a float connection between the barrier assembly 3 and the air outlet. Herein, the float connection means that when the barrier assembly floats in the second liquid level position under the buoyancy action of the liquid, the barrier assembly may be connected with (contact) the air outlet 22. In particular, the barrier assembly 3 may float in the second liquid level position under the buoyancy action of the liquid to block the air outlet 22, such that the air within the liquid storage structure 1 is prevented from drawing out, and the liquid is correspondingly prevented from entering the liquid storage structure 1. In this way, the liquid is avoided from overflowing out of the reservoir device, that is, the physical protection of the reservoir device is achieved.

In an embodiment, the electrical controller comprises an alarm. The alarm is configured to output a signal indicating that a liquid level of the liquid has reached or exceeded the first liquid level position, when the barrier assembly 3 blocks the sensor 5 from sensing the sensing field. In this embodiment, the reservoir device is capable of reminding the user through the alarm that the liquid level of the liquid has reached or exceeded the first liquid level position, such that the user may be timely reminded to tackle the liquid filled in the reservoir device, for example, reminding the user to remove the sewage from the reservoir device.

In some embodiments, the barrier assembly 3 comprises a floating part 31 and a barrier part 32. The liquid storage structure 1 is provided with a rod 13 inside. The floating part 31 is connected with the rod 13 in a sliding manner. The barrier part 32 is arranged at the floating part 31. In this embodiment, the barrier assembly adopts a combination of the floating part and the barrier part. The floating part is easily accessible, the barrier part is arranged at the floating part, the manufacture of which is convenient.

In this embodiment, the floating part 31 may float (up-down movement) under the buoyancy action of the liquid. Since the floating part 31 and the rod 13 are in slidable connection, the rod may restrict the left-right direction of the floating part 31 to a certain degree, which therefore prevents the floating part 31 from violently shaking or swinging randomly in the left-right direction, so that the barrier assembly 3 may accurately block the sensor from sensing the sensing field when floating in the first liquid level position, to avoid failure in the electric control protection.

The specific material of the floating part is not particularly limited herein in this embodiment. The floating part 31 is slidably connected to the rod 13. For example, the floating part 31 may be sleeved outside the rod 13, the floating part 31 may be slidable up and down along the rod 13. In other embodiments, the floating part 31 and the rod 13 may adopt other connection manners for realizing slidable connection, which is not particularly limited herein in this embodiment.

In an embodiment, the sensing field generator 4 is a magnet. The sensor 5 is a Hall sensor. The Hall sensor is in electrical connection with the electrical controller. In addition, the barrier part 32 may be insulating paper. In this embodiment, the sensing field generator 4 for generating the sensing field is a magnet, the sensor 5 for sensing the sensing field is a Hall sensor, the Hall sensor is in electrical connection with the electrical controller, and the barrier part 32 is an insulating paper configured to isolate the magnetic field of the magnet. The Hall sensor has firm structure, small size, light weight, long service life, easy installation, and is not affected by pollution or corrosion from dust, oil, water vapor, and salt spray. The electrical controller provided by this embodiment may obtain the sensing signal of the Hall sensor. When the floating part 31 does not reach the first liquid level position, the Hall sensor senses the magnetic field generated by the magnet. When the floating part 31 reaches the first liquid level position, the insulating paper insulates the magnetic field between the Hall sensor and the magnet, and the electrical controller controls the liquid feeder 2 to stop feeding the liquid into the liquid storage structure 1. The electrical controller may also output a signal indicating that the liquid level of the liquid has reached or exceeded the first liquid level position, so that the user may understand the liquid level within the liquid storage structure 1.

In an optional embodiment, the sensor 5 is arranged outside the liquid storage structure 1, which allows the sensor 5 to be easily connected with other components, for example, the sensor 5 may be easily connected with the electrical controller.

As an example, rather than limitation, a first accommodating groove is provided outside the liquid storage structure 1 and is configured as a space for accommodating the sensor 5, that is, the sensor 5 is arranged in the first accommodating groove.

In some embodiments, the sensing field generator 4 is arranged inside the liquid storage structure 1. In this way, a distance between the sensing field generator 4 and the sensor 5 may be shortened, so as to avoid the following phenomenon: when the distance between the sensing field generator 4 and the sensor 5 is excessive, the sensor 5 is unable to sense the sensing field generated by the sensing field generator 4 although in case of no blocking of the barrier assembly 3.

As an example, rather than limitation, an installation bracket is arranged within the liquid storage structure 1, and the sensing field generator 4 is arranged at the installation bracket.

In some embodiments, the sensing field generator 4 is arranged outside the liquid storage structure 1, which is convenient for the operation to the sensing field generator 4. For example, it is convenient for the user to replace the sensing field generator 4.

As an example, rather than limitation, a second accommodating groove is arranged outside the liquid storage structure 1, and is configured as a space for accommodating the sensing field generator 4. The sensing field generator 4 is arranged inside the second accommodating groove.

Figure 3:
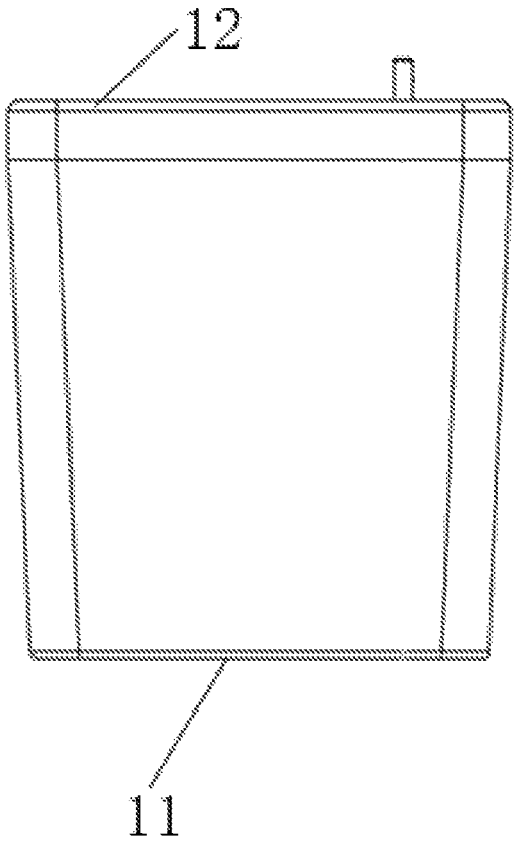
FIG. 3 is a structural schematic view of a reservoir device provided by an embodiment of the present application.

FIG. 3 is a structural schematic view of a reservoir device provided by an embodiment of the present application. Referring to FIG. 1 and FIG. 3, as an optional embodiment, the liquid storage structure 1 includes a tank 11 and a cover 12. The tank 11 and the cover 12 are in hermetical connection. Besides, the tank 11 and the cover 12 are detachably connected. One end of the rod 13 is arranged at the cover 12 or the tank 11, the cover 12 is provided with an installation bracket 14 extending toward the inside of the liquid storage structure 1. The sensing field generator 4 is provided at the installation bracket 14. In this embodiment, the liquid storage structure 1 includes the tank 11 and the cover 12, the tank 11 and the cover 12 are detachably connected, the installation bracket is arranged at the cover 12, and the magnet is fixed on the installation bracket 14, which is convenient for manufacturing.

Herein, specific working principle of the reservoir device provided by this embodiment is explained taking the water storage process of the reservoir device as an example.

Referring to FIGS. 1-2, the liquid storage structure 1 provided by this embodiment is used to store water. The liquid feeder 2 includes the liquid inlet 21 and the air outlet 22, both of which are defined at the liquid storage structure 1. The air outlet 22 is used to connect the air suction mechanism in the external. When the air suction mechanism pumps the air out of the liquid storage structure 1 through the air outlet 22, negative pressure is generated in the liquid storage structure 1, and therefore water enters the liquid storage structure 1 through the liquid inlet 11. The barrier assembly 3 includes the floating part 31 and the barrier part 32. The liquid storage structure 1 is provided with the rod 13 inside, the floating part 31 is connected with the rod 13 in a sliding manner, and the barrier part 32 is provided at the floating part. The sensing field generator 4 may be a magnet, the sensor 5 may be a Hall sensor, the Hall sensor is electrically connected to the electrical controller, and the barrier part 32 may be an insulating paper. The floating part 31 slides relative to the rod 13 under the buoyancy of the water in the liquid storage structure 1, and the barrier part 32 blocks the Hall sensor from sensing the magnetic field of the magnet. The electrical controller outputs a signal indicating that the liquid level of the liquid has reached or exceeded the first liquid level position when the Hall sensor does not sense the magnetic field, and controls the air suction mechanism to stop pumping the air out of the liquid storage structure 1, thus realizing the electric control protection of the reservoir device. When the electric control protection fails, the air suction mechanism continues to pump the air out of the liquid storage structure 1, and the floating part 31 continues to float along the rod 13 under the buoyancy of the water in the liquid storage structure 1, until reaching the second liquid level position. In such condition, the floating part 31 blocks the air outlet 22, and thus prevents the air in the liquid storage structure 1 from being drawn out, and then the liquid is stopped from entering the liquid storage structure 1, thereby realizing the physical protection of the reservoir device.

It may be seen from the above that the reservoir device provided by this embodiment may be protected in manners of electric control protection as well as physical protection, so as to avoid accidents caused by failure of a single protection structure, thereby improving the user experience.

Figure 4:
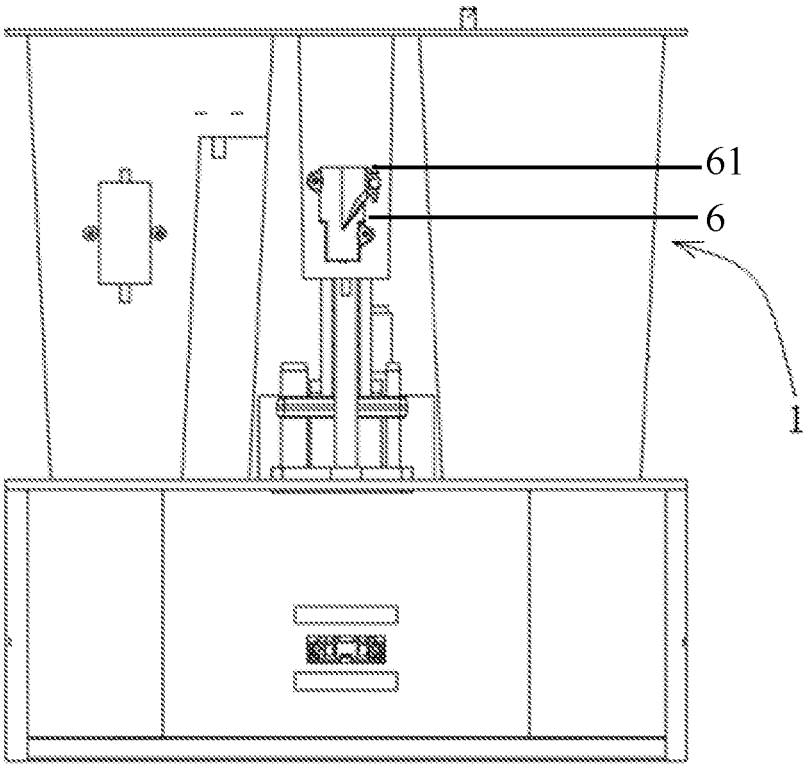
FIG. 4 is a structural schematic view of a cleaning apparatus provided by an embodiment of the present application from a certain viewing angle.
Figure 5:
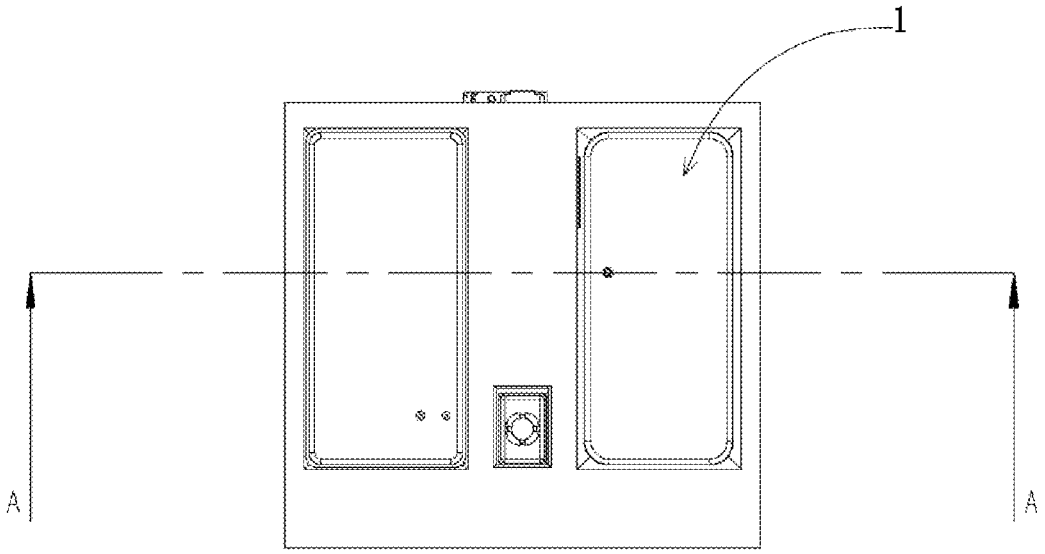
FIG. 5 is a structural schematic view of the cleaning apparatus provided by an embodiment of the present application from another viewing angle.
Figure 6:
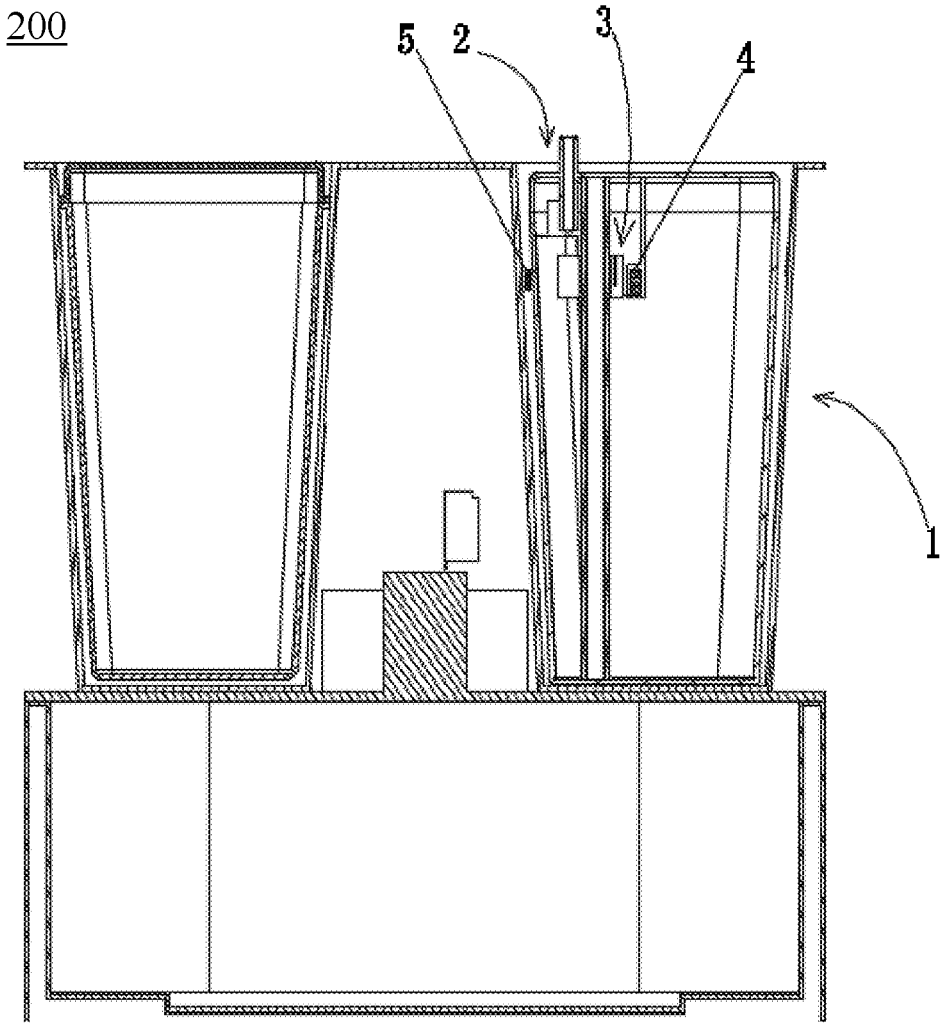
FIG. 6 is a structural schematic view of a cross section taken from line A-A of FIG. 5.

FIG. 4 is a structural schematic view of a cleaning apparatus provided by an embodiment of the present application from a certain viewing angle. FIG. 5 is a structural schematic view of the cleaning apparatus provided by an embodiment of the present application from another viewing angle. FIG. 6 is a structural schematic view of a cross section taken from line A-A of FIG. 5. Referring to FIGS. 4-6, a cleaning apparatus is provided by a second aspect of embodiments of the present application. The cleaning apparatus includes the reservoir device as described in the above embodiments.

For example, the reservoir device comprises: a liquid storage structure 1, a liquid feeder 2, a barrier assembly 3, a sensing field generator 4, a sensor 5, and an electrical controller. The liquid storage structure 1 is configured to store liquid. The liquid feeder 2 is configured to feed the liquid into the liquid storage structure 1. The sensing field generator 4 is configured to generate a sensing field. The barrier assembly 3 is arranged inside the liquid storage structure 1. The sensor 5 is configured to sense the sensing field. The barrier assembly 3 is configured to float under a buoyance action of the liquid, and to block the sensor 5 from sensing the sensing field when the barrier assembly floats in a first liquid level position. The electrical controller is configured to control the liquid feeder 2 to stop feeding the liquid into the liquid storage structure 1 when the barrier assembly 3 blocks the sensor 5 from sensing the sensing field.

In some embodiments, the cleaning apparatus is a device that may be used to maintain a robot. For example, the cleaning apparatus may be used to clean a mop of the robot, and the mop is an assembly equipped by the robot for mopping the surface of an object.

The cleaning apparatus provided by embodiments of the present application includes the reservoir device as described in the above. When the liquid collected in the liquid storage structure of the reservoir device reaches the first liquid level position, the electrical controller controls the liquid feeder to stop feeding the liquid into the liquid storage structure, such that the liquid is stopped from entering the reservoir device when the liquid stored in the reservoir device has reached a preset liquid level, which avoids the accidents caused by overflow of the reservoir device. In this way, the user experience is improved.

The above embodiments are only used to illustrate, rather than limit, the technical solutions of the present application. Although the present application has been described in detail with reference to the foregoing embodiments, those skilled in the art should understand that technical solutions recorded in the foregoing various embodiments may be modified, or some or all technical features therein may be equivalently replaced. And these modifications or replacements do not cause the essence of the corresponding technical solutions to deviate from the scope of the technical solutions of the embodiments of the present application.

What is claimed is:

1. A reservoir device, comprising: a liquid storage structure feeder, configured to store liquid; a liquid feeding assembly feeder, configured to feed the liquid into the liquid storage structure; a barrier assembly; a sensing field generator, configured to generate a sensing field; a sensor; and an electrical controller; wherein the barrier assembly is arranged inside the liquid storage structure; the sensor is configured to sense the sensing field; the barrier assembly is configured to float in the liquid, and to block the sensor from sensing the sensing field when the barrier assembly floats in a first liquid level position; and the electrical controller is configured to control the liquid feeding assembly feeder to stop feeding the liquid into the liquid storage structure when the barrier assembly blocks the sensor from sensing the sensing field.

2. The reservoir device of claim 1, wherein the barrier assembly is further configured to stop the liquid feeder from feeding the liquid into the liquid storage structure when the barrier assembly floats in a second liquid level position.

3. The reservoir device of claim 1, wherein the liquid feeder comprises a liquid inlet and an air outlet, and both the liquid inlet and the air outlet are defined on the liquid storage structure;

the air outlet is configured to connect with an air suction mechanism outside;

the air suction mechanism is configured to draw air out of the liquid storage structure via the air outlet, so that a negative pressure is generated in the liquid storage structure, and the liquid enters the liquid storage structure through the liquid inlet;

the air suction mechanism is configured to be in electrical connection with the electrical controller; and the electrical controller is configured to control the air suction mechanism to stop drawing the air out of the liquid storage structure when the barrier assembly blocks the sensor from sensing the sensing field.

4. The reservoir device of claim 2, wherein the liquid feeder comprises a liquid inlet and an air outlet, and both the liquid inlet and the air outlet are defined on the liquid storage structure;

the air outlet is configured to connect with an air suction mechanism outside;

the air suction mechanism is configured to draw air out of the liquid storage structure via the air outlet, so that a negative pressure is generated in the liquid storage structure, and the liquid enters the liquid storage structure through the liquid inlet;

the air suction mechanism is configured to be in electrical connection with the electrical controller; and the electrical controller is configured to control the air suction mechanism to stop drawing the air out of the liquid storage structure when the barrier assembly blocks the sensor from sensing the sensing field.

5. The reservoir device of claim 3, wherein the barrier assembly and the air outlet are configured to achieve a float connection between the barrier assembly and the air outlet.

6. The reservoir device of claim 4, wherein the barrier assembly and the air outlet are configured to achieve a float connection between the barrier assembly and the air outlet.

7. The reservoir device of claim 1, wherein the electrical controller comprises an alarm; and the alarm is configured to output a signal indicating that a liquid level of the liquid has reached or exceeded the first liquid level position, when the barrier assembly blocks the sensor from sensing the sensing field.

8. The reservoir device of claim 1, wherein the sensor is arranged outside the liquid storage structure.

9. The reservoir device of claim 8, wherein the sensing field generator is arranged inside the liquid storage structure.

10. The reservoir device of claim 1, wherein the sensing field generator is a magnet;

the sensor is a Hall sensor; and the Hall sensor is in electrical connection with the electrical controller.

11. The reservoir device of claim 1, wherein the barrier assembly comprises a floating part and a barrier part;

the liquid storage structure is provided with a rod inside;

the floating part is connected with the rod in a sliding manner; and the barrier part is arranged on the floating part.

12. A cleaning apparatus for cleaning a mop of a robot, the cleaning apparatus comprising a reservoir device, and the reservoir device comprising:

a liquid storage structure, configured to store liquid;

a liquid feeder, configured to feed the liquid into the liquid storage structure;

a barrier assembly;

a sensing field generator, configured to generate a sensing field;

a sensor; and an electrical controller;

wherein the barrier assembly is arranged inside the liquid storage structure;

the sensor is configured to sense the sensing field;

the barrier assembly is configured to float in the liquid, and to block the sensor from sensing the sensing field when the barrier assembly floats in a first liquid level position; and the electrical controller is configured to control the liquid feeding assembly to stop feeding the liquid into the liquid storage structure when the barrier assembly blocks the sensor from sensing the sensing field.

13. The cleaning apparatus of claim 12, wherein the barrier assembly is further configured to stop the liquid feeder from feeding the liquid into the liquid storage structure when the barrier assembly floats in a second liquid level position.

14. The cleaning apparatus of claim 12, wherein the liquid feeder comprises a liquid inlet and an air outlet, and both the liquid inlet and the air outlet are defined on the liquid storage structure;

the air outlet is configured to connect with an air suction mechanism outside;

the air suction mechanism is configured to draw air out of the liquid storage structure via the air outlet, so that a negative pressure is generated in the liquid storage structure, and the liquid enters the liquid storage structure through the liquid inlet;

the air suction mechanism is configured to be in electrical connection with the electrical controller; and the electrical controller is configured to control the air suction mechanism to stop drawing the air out of the liquid storage structure when the barrier assembly blocks the sensor from sensing the sensing field.

15. The cleaning apparatus of claim 14, wherein the barrier assembly and the air outlet are configured to achieve a float connection between the barrier assembly and the air outlet.

16. The cleaning apparatus of claim 12, wherein the electrical controller comprises an alarm; and the alarm is configured to output a signal indicating that a liquid level of the liquid has reached or exceeded the first liquid level position, when the barrier assembly blocks the sensor from sensing the sensing field.

17. The cleaning apparatus of claim 12, wherein the sensor is arranged outside the liquid storage structure.

18. The cleaning apparatus of claim 17, wherein the sensing field generator is arranged inside the liquid storage structure.

19. The cleaning apparatus of claim 12, wherein the sensing field generator is a magnet;

the sensor is a Hall sensor; and the Hall sensor is in electrical connection with the electrical controller.

20. The cleaning apparatus of claim 12, wherein the barrier assembly comprises a floating part and a barrier part;

the liquid storage structure is provided with a rod inside;

the floating part is connected with the rod in a sliding manner; and the barrier part is arranged on the floating part.

* * * * *